United States Patent [19]

Radd et al.

[11] Patent Number: 4,833,915

[45] Date of Patent: May 30, 1989

[54] METHOD AND APPARATUS FOR DETECTING FORMATION HYDROCARBONS IN MUD RETURNS, AND THE LIKE

[75] Inventors: Frederick J. Radd, Ponca City; Howard H. Ferrell, Tulsa, both of Okla.

[73] Assignee: Conoco Inc., Ponca City, Okla.

[21] Appl. No.: 128,979

[22] Filed: Dec. 3, 1987

[51] Int. Cl.[4] ..... E21B 49/02

[52] U.S. Cl. ..... 73/153

[58] Field of Search ..... 73/153, 19, 863.21; 175/50, 40, 58–60; 166/250, 254, 264; 436/30, 25; 250/254, 255

[56] References Cited

U.S. PATENT DOCUMENTS

| | | | |
|---|---|---|---|
| 2,229,884 | 1/1941 | Chalkley | 166/264 |
| 2,489,180 | 11/1949 | Hayward | 73/153 |
| 3,118,299 | 1/1964 | Worthington | 436/30 |
| 3,240,068 | 3/1966 | Horeth et al. | 436/30 |
| 3,462,761 | 8/1969 | Horeth et al. | 73/153 |
| 3,701,388 | 10/1972 | Warren | 175/50 |
| 3,899,926 | 8/1975 | Haden | 73/153 |
| 4,378,055 | 3/1983 | Bartz | 436/38 |
| 4,546,640 | 10/1985 | Stone et al. | 73/153 |
| 4,635,735 | 1/1987 | Crownover | 175/48 |
| 4,739,655 | 4/1988 | Greer et al. | 73/153 |

OTHER PUBLICATIONS

"GRI's Basic Research on Gas Origin, Migration"; Fish, Ferol and William Staats; *Oil and Gas Journal;* Feb. 10, 1986; pp. 118–126.

*Primary Examiner*—Stewart J. Levy
*Assistant Examiner*—Robert R. Raevis
*Attorney, Agent, or Firm*—Richard K. Thomson

[57] ABSTRACT

A method and logger apparatus for analyzing mud returns to determine the presence of formation hydrocarbons. The logger takes a gas sample from a gas trap formed in the mud return line, purges it of all non-helium gases either by condensing them or chemically reacting them out of the sample. The sample is then fed into a special helium mass spectrometer that identifies how much of each helium isotope ($^3He$ and $^4He$) is present. This data is then fed to a correlator/computer and an isotope ratio calculated and monitored. A significant increase in this ratio is indicative of the presence of formation hydrocarbons. The computer uses additional input to track the sample vs its original downhole location to enable proper identification. The method and apparatus are particularly useful with oil-based drilling fluids.

20 Claims, 1 Drawing Sheet

METHOD AND APPARATUS FOR DETECTING FORMATION HYDROCARBONS IN MUD RETURNS, AND THE LIKE

BACKGROUND AND SUMMARY OF THE INVENTION

The present invention relates to a logging tool for use with mud returns during the drilling of petroleum wells. More particularly, the present invention is directed to a method and logger apparatus for monitoring the helium isotope ratio of a gas sample taken from the cuttings-ladened, drilling fluid returns of a drilling system employing an oil-containing mud, so as to prevent unknowingly drilling through an oil-bearing formation.

In the drilling of oil and gas wells, two types of drilling fluids (or muds) are used: water-based and oil-based. While each type of fluid has its own set of advantages, the oil-based fluids are particularly useful in unconsolidated and water-susceptible formations. One problem with oil-based drilling fluids, however, is the possibility of drilling through an oil-bearing formation without knowing it, since the hydrocarbons in the drilling fluid will mask the formation fluids in the drilling mud returns, thus preventing visual identification. Even when water-based muds are used, diesel fuel or other middle to heavy hydrocarbons will typically be added to the mud system to help lubricate the drill bit causing a similar hydrocarbon-masking problem.

In taking a series of readings in pre-drilled wells, it was determined that the wells which were flowing best and represented the largest reservoirs had appreciably higher $^3He$ to $^4He$ ratios than did the depleted reservoirs and, more importantly, this helium isotope ratio was significantly higher in the liquid hydrocarbon deposits than in normal atmospheric conditions or even in the gaseous hydrocarbons. This discovery gave rise to the proposed method and apparatus of the present invention for avoiding overlooking drilling through an oil-bearing region.

The method of the present invention comprises taking a gas sample from the cuttings-ladened oil-containing drilling fluid returns, analyzing the sample to determine the amounts of $^3He$ and $^4He$ present, calculating the $^3He/^4He$ isotope ratio, monitoring the magnitude of this helium isotope ratio as well as the levels of the two isotopes to be able to detect significant increases and/or other changes in these values which would indicate the presence or proximity of formation hydrocarbons and/or of significant structural variations.

Apparatus for performing the steps of this method comprises a gas trap positioned in the mud return line. As the cuttings-ladened mud returns pass through the gas trap, the helium isotopes, which had been held in solution in the liquid hydrocarbons by the downhole pressures, will be released and accumulate in the gas trap. A sampling nipple will permit gas samples to be extracted either continuously or periodically, as desired. At least a portion of the sample will be processed through a purification train to condense or precipitate out all gases from the sample which might interfere with a helium analysis. Another portion of the sample may be subjected to gas chromatography to analyze all hydrocarbon gases present and to provide a cross-check data point for the logging tool. The above-processed portion of the sample will be fed to a specially constructed mass spectrometer designed to examine these helium samples and to assess the $^3He$ and $^4He$ isotope components. The data output from this specialized mass spectrometer may be fed to (1) a data correlator/processor to be formatted for a computer, (2) to the computer directly if already in the proper format, (3) to a logger printer for tabulation with other data, (4) to a display screen, and/or 5) to an alarm/signal device to advise the operator that hydrocarbons are present. Other relevant data such as mud temperature, drill bit location and penetration rate, and hydrogen (and oxygen) levels in the drilling mud, may also be fed to the correlator and/or computer and plotted by the logger printer.

Various other features, advantages and characteristics of the present invention will become apparent after a reading of the following detailed description.

DETAILED DESCRIPTION OF THE PREFERRED EMBODIMENT(S)

Figure 1:
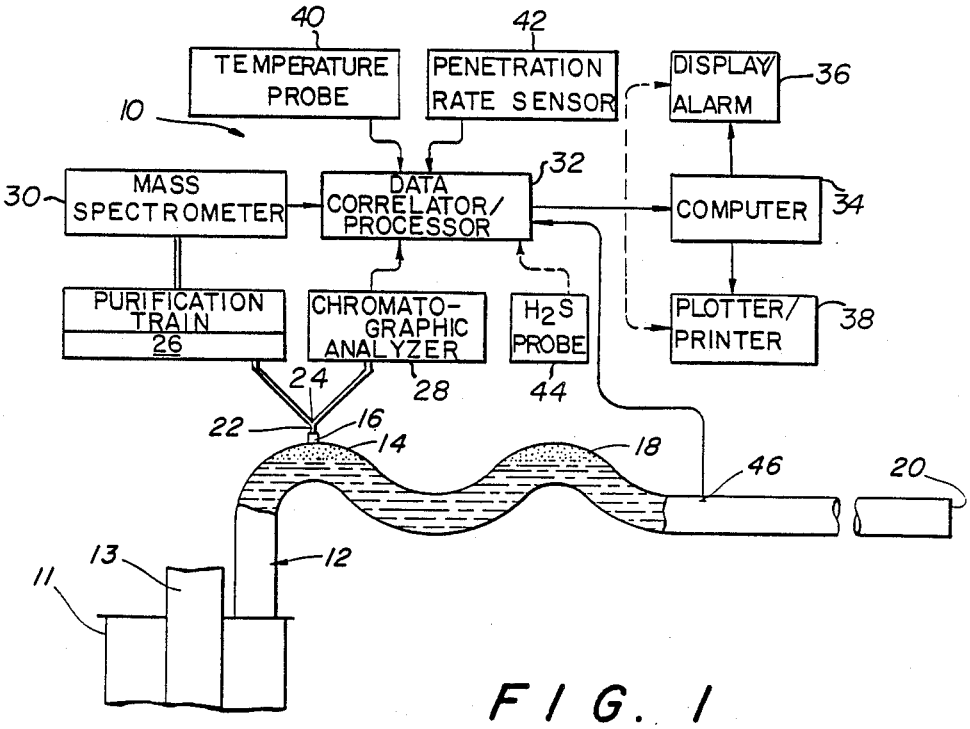
FIG. 1 is a schematic diagram of the components of the logging tool of the present invention.

The present invention comprises a new logging method and apparatus for use with the cuttings-ladened mud returns to ascertain the presence of formation hydrocarbons in those mud returns by the determination of helium content variations therein. The apparatus is depicted in the FIG. 1 generally at 10. Drilling fluid or mud is pumped into borehole 11 through drill string 13 to lubricate the drill bit (not shown).

A contoured mud return line 12 is configured in the shape of an 'M'. It will, of course be appreciated that others gas trap configurations could be employed. The first hump 14 of the 'M' is equipped with a sampling nipple 16. It may be desirble to have a flushing gas/vent sampling unit at this juncture since clean, periodic samples are desirable. The second (and subsequent) hump(s) 18 of the 'M' protects the sampling zone in hump 14 from contamination by atmospheric gases that may creep into the mud return line 12 from the outlet end 20. Second hump 18 may be equipped with a vent and/or flushing gas system (not shown) to prevent a built-up of such atmospheric gases that might permit propagation of these contaminants upstream.

A sampling line 22 receives the gas sample from sampling nipple 16 and may split the sample as at 24, carrying a first portion to purification train 26 and a second sample portion may be fed into gas chromatographic analyzer 28. Sampling may be performed continuously or selectively at, for example, transition zones of a given or a new formation as may be indicated by a change in drill bit penetration rate.

Purification train 26 is shown as being subdivided into a plurality of compartments or stages. These stages may comprise a succession of cryogenic cooling chambers utilizing, for example, an alcohol/dry ice bath, a liquid nitrogen bath, (with or without a chemical trap) to condense out all relevant non-helium gases. As an alternative, one or more of these condensing stages of the purification train might be replaced by a reaction chamber wherein a specific reactive agent, such as titanium, might be employed to cause hard-to-condense gases, such as hydrogen and nitrogen, to be removed from the gas sample by chemically reacting with the agent.

Gas chromatographic analyzer 28 will be used to analyze the second portion of the gas sample looking particularly for hydrocarbons and for oxygen/nitrogen. It is important to identify whether oxygen and nitrogen are in the sample (i.e., whether or not atmospheric contamination of the sample has occurred) so that the helium data may be corrected to eliminate the effects of such contamination. In addition, both oxygen and nitrogen (especially the latter) occur naturally in some petroleum reservoirs. Further, variations in such constituents will occur across a single field as well as vertically in a single well. Therefore, such variations can also be used to provide information regarding fissures and fractures in the formation and about the fracture systems present in a given reservoir.

The helium portion of the first sample portion will emerge from the gas purification train 26 and be pumped into a special helium mass spectrometer 30. Mass spectrometer 30 can identify the amount $^3He$ and $^4He$ present in the sample. This helium isotope output data is fed to a data correlator/processor 32 so that an isotope ratio may be calculated and the data may be formatted as necessary for introduction to a computer 34, a display screen and/or alarm 36 or a logger plotter or printer 38.

The data correlator 32 may receive and process data from additional input sources such as the gas chromatographic analyzer 28, a mud returns temperature probe 40 (the amount of gas held in solution in a formation fluid being a function of temperature), a drill bit penetration rate sensor 42, and, optionally, a hydrogen sulfide probe 44, as well as a mass flow rate sensor 46 for the mud returns. Alternatively, mass flow rate data may be taken from the pump (not shown) used to pump the drilling mud downhole. These data are formatted and fed to computer 34 which computes the drill bit depth location as well as the location from which a sample was taken and enables a formation-hydrocarbon-containing sample to be accurately matched with the probable formation zonal depth from which it came. In deep formation drilling, these sample delay times must be accounted for since the presently delivered sample has been delayed, having had to travel up the borehole in the mud system, be processed out, analyzed, etc. This will be important to enable perforating the correct portion of the casing to optimize production of fluids. The data will also be fed to a plotter 38 to formulate a printout or helium isotope map of the borehole, as well as mapping other parameters than can affect helium content such as mud temperature, and other pertinent data.

Of course, if the data produced by the various measuring devices is already in a computer-compatible format, the correlator 32 may be eliminated and the data be input directly to the computer 34, which will compute the helium isotope ratio. As indicated earlier, the data may be fed from the computer 34 to display screen/alarm 36 and logger plotter 38, or alternatively, as shown in dotted lines, the data may be fed directly from the correlator 32 to the peripheral equipment.

As a means of demonstrating the value of knowing both the total helium content and helium isotope ratio of a sample, measurement data for a suite of wells from the same oil field reservoir in Wyoming are presented in Table 1 along with commentary on the nature of the well as a result of data analysis, this commentary being presented under the heading "Condition". The half dozen wells have a depth range of seventy feet in a typical anticlinal reservoir.

TABLE 1

| Well Ho. & Description | Total Helium (ppm) | $^3He/^4He(\times 10^7)$ Ratio | Total BTU of Gas(BTU/ft$^3$) | Condition |
|---|---|---|---|---|
| I. Uppermost zone of anticline | 49 | 3.1 | 1716 | Not macrofracture controlled |
| Ia. Uppermost zone of Anticline | 279 | 1.7 | 1673 | A "leaky" roof gassy state ($^3He$ escapes) |
| II. Upper Intermediate zone | 19 | 4.9 | 2151 | Little free gas in well fluids |
| III. Lower Intermediate zone | 21 | 6.3 | 2156 | More fresh oil |
| IV. Normal Bottom zone | 10 | 7.1 | 1973 | Reflects new oil releases |
| IVa. $CO_2$-Flushed Bottom zone | 49 | 2.3 | 2844 | Partially gas-purged crude oil |

In analyzing the data, it became apparent that the data from wells Ia and IVa were anomalous. The extremely low values for the helium isotope ratios for these two wells were the clues that something unusual had occurred. This is particularly so in well Ia where the total helium is high but the $^3He$ value is peculiarly low. This suggests that the porosity of the cap rock above this well was insufficient to maintain the gas pressure above the oil deposit (a condition identified as a "leaky roof").

Accordingly, the $^3He$, which has a much lower solubility in liquid petroleum than $^4He$, escapes from solution and finds its way through the porous cap rock.

Well IVa in the bottom zone also has a helium isotope ratio below what would be expected. This region of the well has apparently been subjected to a natural form of $CO_2$ flooding. There is a very high probability that a subterranean stream which has entrained $CO_2$ and which passes through one corner of the field apparently has caused a part of the entrapped $^3He$ to be bubbled out of the solution. This $CO_2$ purging hypothesis is supported by the higher BTU content of the entrapped gas, suggesting that only the heavier hydrocarbon gases are present, the lighter hydrocarbon gases having also been effervesced.

Figure 2:
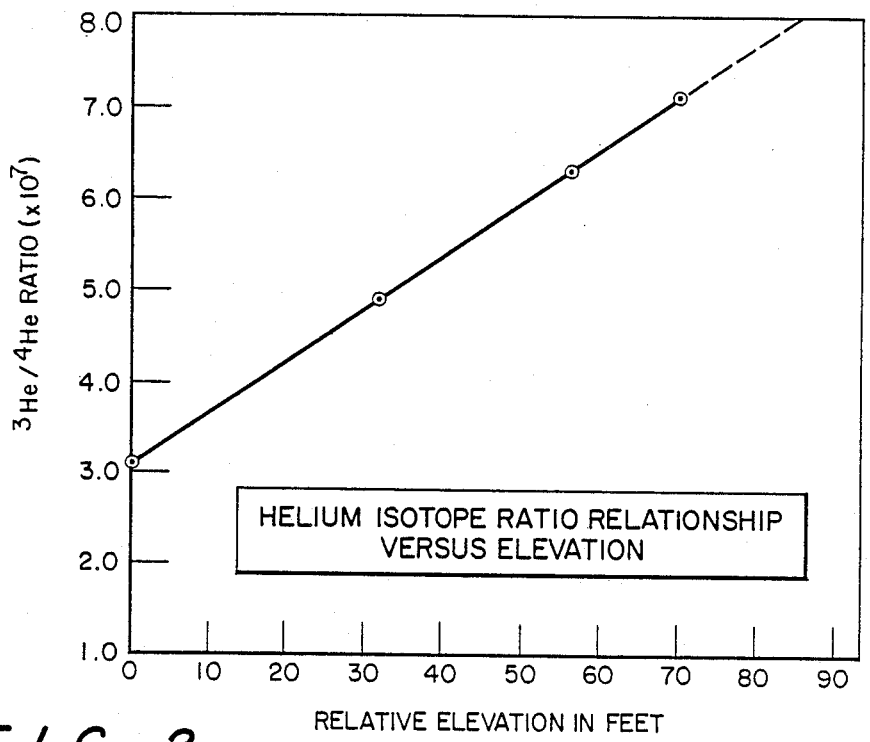
FIG. 2 is a plot of helium isotope ratio vs. depth for a plurality of similarly situated wells.

FIG. 2 shows the helium isotope ratios from wells I–IV plotted against depth, with depth increasing to the right. As can be seen from the plot, the helium isotope ratio increases linearly with depth. This data corresponds to Henry's Law which states that the amount of gas dissolved in a liquid is directly proportional to the pressure of the gas at constant temperature. Since hydrostatic pressure increases linearly with depth, FIG. 2 demonstrates the relationship one would expect from Henry's Law with all other things being equal (e.g., no "leaky roof" or $CO_2$ effervescing, etc.).

Table 1 and FIG. 2 demonstrate the value of knowing the absolute amount of helium and helium isotope ratio for a particular well and suggests that the logging tool of the present invention will form an important addition to a field developer's arsenal.

The helium logger 10 of the present invention, extracts a gas sample from the mud return line 12, purges the sample of all or most of the non-helium constituents in stepwise purification train 26, and analyzes the remaining purged sample for amounts of $^3He$ and $^4He$ in the special helium mass spectrometer 30. Output from mass spectrometer 30 is input into correlator 32 which may compute a helium isotope ratio ($^3He/^4He$) or may simply format the data so that the calculation may be performed by the computer 34. Related information from a gas chromatographic analyzer 28, a mud temperature probe 40, a drill bit penetration rate sensor 42, a hydrogen sulfide probe 44 are also fed to correlator 32 and used to (1) substantiate the helium isotope data results and (2) to track a particular cutting from the formation with its depth in hole. This enables the operator to associate a particular gas sample whose helium isotope ratio suggests the presence or proximity of hydrocarbons with a particular formation depth. This early warning will enable the operator to take preventative steps (e.g. by increasing the mud weight) to avoid a possible blowout which might occur when drilling through an overpressured (or a superpressured) zone.

While this helium logger 10 has been described only in conjunction with oil exploration, it will be apparent that the logger of the present invention will be useful in other applications, as well. For example, when tunneling through a mountain or in mining operations, the presence of hydrocarbons can pose a threat to workmen and the helium logger of the present invention could be used to give early warning of the danger. This could be done by drilling a pilot hole in advance of blasting and/or by modifying the tool to process helium in air samples. Further, the logger may be useful in establishing that a drilled wellbore is proximate a formation deposit (by monitoring a helium isotope ratio emitted from fissure gas) suggesting that an angulated or lateral borehole made from the existing borehole might enable the formation deposit to be tapped rather than the expensive alternative of plugging and abandoning a dry hole. In addition, the method and apparatus would be useful in forewarning an operator that he/she is approaching a high-pressure zone prior to tapping into it by monitoring the isotope ratio and making him/her aware of this condition by a sudden helium level anomaly or peak. Lastly, the method and apparatus would be used to detect the presence of hydrocarbons by lowering the logging sampler into a predrilled wellbore using conventional logging techniques.

Various changes, alternatives and modifications will become apparent to a person of ordinary skill in the art following a reading of the foregoing description. It is intended that all such changed, alternatives and modifications as come within the scope of the appended claims be considered part of the present invention.

We claim:

1. A method of drilling a hydrocarbon well borehole using a conventional hydrocarbon-containing drilling fluid, said method comprising circulating said drilling fluid in a conventional manner through a drill string and returning said fluid ladened with cuttings upwardly outside the drill string;

taking a gas sample from said cuttings-ladened drilling returns; analyzing at least a portion of said gas sample to determine its ratio of $^3He$ to $^4He$;

monitoring the helium isotope ratio for significant increases in said ratio, so as to avoid the possibility of drilling through an oil-bearing zone without knowing it.

2. The drilling method of claim 1 further comprising the step of tracking said cuttings-ladened drilling fluid returns and said corresponding gas samples so as to be able to accurately identify a specific region of said borehole from which each was taken.

3. The drilling method of claim 2 wherein said sampling, analyzing and monitoring steps are performed on a substantially continuous basis.

4. The drilling method of claim 2 wherein said sampling, analyzing and monitoring steps are performed at or near formation interfaces which are manifested by significant changes in drill penetration rate.

5. The drilling method of claim 1 further comprising the step of chilling the gas sample to condense out substantially all non-helium gases prior to analyzing said sample.

6. The drilling method of claim 1 further comprising the step of determining the level of total helium present.

7. The drilling method of claim 6 further comprising the step of producing a formation correlation map of total helium content and of said isotope ratio as they vary with depth.

8. The drilling method of claim 1 further comprising the step of producing a formation correlation map of each helium isotope and of said isotope ratio.

9. Apparatus for detecting the presence of formation oil in a cuttings-ladened drilling mud, said apparatus comprising a mud return line, said return line having a portion configured in the shape of an 'M', or similar gas trapping configuration;

a sampling nipple positioned on the first hump of said 'M', or similar gas trapping configuration, near an uppermost portion thereof for enabling a gas sample to be taken from said cuttings-ladened mud returns;

said second and/or subsequent hump(s) of said 'M' or similar gas trapping configuration providing a means to protect said sample from contamination from atmospheric air which might enter said mud return line from a discharge end thereof;

means for removing all non-helium gases from said mud returns sample;

means to analyze said residual helium gas to determine the amount of $^3He$ and $^4He$ present;

means to calculate a ratio of $^3He$ to $^4He$ present in the mud returns gas sample in order to detect the presence or proximity of formation hydrocarbons in said cuttings-ladened mud returns, a significant increase in said helium isotope ratio being indicative of the presence or proximity of formation hydrocarbons.

10. The detecting apparatus of claim 9 further comprising means to precisely determine a specific location downhole from which a formation hydrocarbon-bearing sample came.

11. The detecting apparatus of claim 9 wherein said means for removing all non-helium gas components comprises a stepwise cryogenic cooling chamber to condense out said non-helium components.

12. The detecting apparatus of claim 9 wherein said means for removing all non-helium gas components comprises at least one reaction chamber to chemically remove at least one of the non-helium gas components.

13. The detecting apparatus of claim 9 further comprising a logger plotter to record variations in said helium isotope ratio with borehole depth.

14. Apparatus for detecting the presence of formation hydrocarbons in a cuttings-ladened drilling mud, said apparatus comprising a gas trap for collecting a plurality of successive gas samples;

a purification train for condensing and reacting out substantially all non-helium gas components of at least a portion of each said collected gas sample to create a residual gas sample;

a helium mass spectrometer for analyzing each said residual gas sample to determine an amount of each helium isotope present, each said amount constituting a helium isotope content data point;

a data correlator/processor for formatting and arranging the helium isotope content data and calculating a ratio of a first helium isotope to a second helium isotope and for tracking said ratio in conjunction with such variables as drilling mud temperature and drilling penetration rate;

a computer for recording said data and said corresponding variables and for calculating a position of the drill bit and a depth from which said gas sample came;

a logger printer for parallel plotting at least some of said data and related variables as a function of depth.

15. The detecting apparatus of claim 14 further comprising a gas chromatograph for analyzing a portion of said gas sample, means to split the gas sample as it emerges from said gas trap and to transmit a portion to said gas chromatograph.

16. The detecting apparatus of claim 15 further comprising means to feed the analysis of said chromatograph to said data correlator/processor and/or to said logger printer.

17. The detecting apparatus of claim 14 further comprising display and/or alarm means to make an operator aware of an inordinately large change in the helium isotope ratio.

18. The detecting apparatus of claim 14 wherein said purification train includes a stepwise cryogenic cooling chamber to distill out at least some of the non-helium gas components.

19. The detecting apparatus of claim 14 wherein said purification train includes at least one reaction chamber to chemically precipitate out at least one of said non-helium gas components.

20. The detecting apparatus of claim 19 wherein said reaction chamber employs titanium as a reactive element to precipitate out said at least one non-helium gas component.

* * * * *